US008397939B2

(12) United States Patent
Landeck et al.

(10) Patent No.: US 8,397,939 B2
(45) Date of Patent: Mar. 19, 2013

(54) COMPOSITE COMPRESSED GAS TANK

(75) Inventors: Bastian Landeck, Munich (DE); Gregor Fischer, Ismaning (DE); Achim Baier, Karlsfeld (DE); Sylvain Bastian, Munich (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 141 days.

(21) Appl. No.: 12/912,459

(22) Filed: Oct. 26, 2010

(65) Prior Publication Data

US 2011/0036848 A1 Feb. 17, 2011

Related U.S. Application Data

(63) Continuation of application No. PCT/EP2009/002407, filed on Apr. 2, 2009.

(30) Foreign Application Priority Data

May 20, 2008 (DE) ..... 10 2008 024 292

(51) Int. Cl.
*F17C 1/02* (2006.01)

(52) U.S. Cl. ..... 220/586; 220/288; 220/303; 220/582; 206/0.6

(58) Field of Classification Search ..... 220/288, 220/303, 582, 586; 206/0.6
See application file for complete search history.

(56) References Cited

U.S. PATENT DOCUMENTS

| | | | | |
|---|---|---|---|---|
| 3,030,780 | A * | 4/1962 | Loveday | 62/48.3 |
| 3,689,232 | A | 9/1972 | Baba et al. | |
| 3,889,836 | A | 6/1975 | Anderson | |
| 3,969,812 | A | 7/1976 | Beck | |
| 4,431,111 | A * | 2/1984 | Prohaska | 215/256 |
| 4,778,073 | A | 10/1988 | Ehs | |
| 4,884,708 | A | 12/1989 | Lange et al. | |
| 5,464,247 | A | 11/1995 | Rizzi et al. | |
| 5,711,547 | A | 1/1998 | Blumenthal et al. | |
| 2003/0189053 | A1 * | 10/2003 | Felbaum | 220/582 |
| 2006/0096302 | A1 | 5/2006 | Pechtold | |
| 2006/0144843 | A1 | 7/2006 | Vandal et al. | |

FOREIGN PATENT DOCUMENTS

| | | |
|---|---|---|
| CH | 295038 | 12/1953 |
| DE | 2 152 123 | 5/1973 |
| DE | 2 131 211 | 6/1973 |

(Continued)

OTHER PUBLICATIONS

German Search Report dated Mar. 23, 2009 including partial English translation (Nine (9) pages).

(Continued)

*Primary Examiner* — Anthony Stashick
*Assistant Examiner* — Elizabeth Volz
(74) *Attorney, Agent, or Firm* — Crowell & Moring LLP

(57) ABSTRACT

A composite compressed gas tank has an outer shell and a liner. The liner is made of a light metal, in particular, aluminum or an aluminum alloy. The gas tank has an in-feed and discharge port, in which is inserted a closing element having at least one channel. The closing element is connected directly or indirectly to the liner by a welded joint, and a steel material connecting line is connected to the channel or channels. A transition element has a first end segment made of a light metal, in particular aluminum or an aluminum alloy, and is welded either to the liner or to the closing element if made of a light metal. The other end segment of the transition element is made of a steel material and is welded either to the closing element, or to the connecting line if made of a steel material.

9 Claims, 4 Drawing Sheets

FOREIGN PATENT DOCUMENTS

| | | | |
|---|---|---|---|
| DE | 25 16 395 | A1 | 11/1975 |
| DE | 36 31 975 | A1 | 4/1988 |
| DE | 37 36 579 | A1 | 5/1989 |
| DE | 44 36 016 | C2 | 4/1996 |
| DE | 197 34 915 | C1 | 3/1999 |
| DE | 695 15 774 | T2 | 11/2000 |
| DE | 10 2005 052 290 | A1 | 5/2006 |
| DE | 10 2006 056 489 | A1 | 6/2008 |
| EP | 1 900 994 | A1 | 3/2008 |
| GB | 1 348 308 | | 3/1974 |
| JP | 4-55066 | A | 2/1992 |
| JP | 11-197846 | A | 7/1999 |
| JP | 11-227268 | A | 10/1999 |
| RU | 2 049 615 | C1 | 12/1995 |

OTHER PUBLICATIONS

International Search Report dated Jul. 21, 2009 including English translation (Six (6) pages).

* cited by examiner

COMPOSITE COMPRESSED GAS TANK

CROSS-REFERENCE TO RELATED APPLICATIONS

This application is a continuation of PCT International Application No. PCT/EP2009/002407, filed Apr. 2, 2009, which claims priority under 35 U.S.C. §119 from German Patent Application No. DE 10 2008 024 292.6, filed May 20, 2008, the entire disclosures of which are herein expressly incorporated by reference.

BACKGROUND AND SUMMARY OF THE INVENTION

The invention relates to a composite compressed gas tank that is intended for a gas and that has an outer shell and a liner, which is enveloped by said outer shell and which is made of a light metal, in particular, aluminum or an aluminum alloy, and which has an infeed and discharge port, in which is inserted a closing element having at least one channel for infeeding and/or discharging gas. Such a tank can be used, for example, in a motor vehicle in order to store a compressed natural gas (CNG) or hydrogen, for instance, also in the cryogenic state, as the energy carrier for the vehicle drive unit or for an auxiliary power unit.

The well-known composite compressed gas tanks that are, for example, bottle-shaped and have aluminum liners, are distinguished by a relatively low weight and are, therefore, quite suitable for the storage of compressed gas in vehicles. A newer development goes in the direction of storing cryogenic hydrogen under pressure in the supercritical state as the energy carrier for the drive unit of a vehicle. Under certain operating conditions the stored hydrogen can have a temperature of 35 Kelvin, whereas under other operating conditions pressure values in a magnitude of 300 bar and more can prevail in the pressure tank system. At the same time the goal is to minimize as much as possible any undesired thermal input from the environment into the compressed gas tank.

As well-known, a heat exchange occurs simultaneously over the connecting lines of a compressed gas tank, which is loaded or unloaded by way of these connecting lines. That is, heat is brought into the interior of the compressed gas tank from the environment over these connecting lines, which contain a channel or channels for the infeed of gas into the compressed gas tank or for the discharge of gas from the compressed gas tank. Therefore, with respect to reducing the heat input into the compressed gas tank, the materials that are used for these connecting lines should exhibit a relatively low thermal conductivity (while simultaneously exhibiting adequate strength). Therefore, these connecting lines may be made preferably of stainless steel.

With respect to the aforementioned high pressure values, the connections between the individual lines of the connecting line system and between the connecting line(s) and the aluminum liner of the compressed gas tank must also be configured so as to be absolutely pressure tight, for which reason virtually only a welded joint is suitable for such connections. However, stainless steel as a material is not easily weldable with aluminum.

Therefore, there is needed a composite compressed gas tank comprising a liner, which is made of a light metal, in particular aluminum, and to which can be welded in a relatively easy way the connecting lines or a connecting line made of a steel material, in particular stainless steel.

The need is met by a composite compressed gas tank with an outer shell and a liner, which is enveloped by said outer shell and which is made of a light metal, in particular, aluminum or an aluminum alloy, and which has an infeed and discharge port, in which is inserted a closing element that has at least one channel for infeeding and/or discharging gas and that is connected directly or indirectly to the liner by a welded joint. A connecting line made of a steel material is connected to the channel or channels of the closing element. There is a transition element having a first end segment made of a light metal, in particular aluminum or an aluminum alloy, that is welded either to the liner or to the closing element, which is made of a light metal, in particular aluminum or an aluminum alloy. Another end segment of this transition element is made of a steel material. This other end segment is welded either to the closing element, which is made of a steel material, or to the connecting line, which is made of a steel material.

The invention provides a so-called transition element, through which the channel or channels, continuing in the connecting line, is (are) guided directly or indirectly, that is, with the interposition of another structural element. The two end segments of this transition element are made of different materials, that is, aluminum or a weldable aluminum alloy, on the one hand, and steel, preferably stainless steel, on the other hand.

Thus, it is possible to weld in a relatively easy way this transition element with its first end segment to an aluminum component of the compressed gas tank module that is formed by the compressed gas tank, its closing element and the connecting line, whereas the second end segment of the transition element that is made of steel can be welded in a relatively easy way to a structural element, which is made of a steel material and which is a part of the module, formed by the compressed gas tank, its closing element and the connecting line.

The so-called transition element, of which an aluminum end segment is connected to a (stainless) steel end segment, can be manufactured by means of especially suitable production methods. In this case a manufacturing intensive welded joint between steel, on the one hand, and aluminum, on the other hand, is preferred for safety reasons and tightness reasons. On the other hand, such expensive welded joints, such as preferably friction welding or explosion welding, at a separate transition element can still be implemented in a relatively simple way, as long as there are no other components, like the compressed gas tank itself or the connecting line(s), in the vicinity or as long as such other components do not have to be considered. In particular, owing to the high pressure conditions that have to be maintained when the compressed gas tank of the invention is operating, it can be advisable to provide a clamping element that surrounds the transition element, in particular in the abutting area and/or the joining area of the two materials (that is, aluminum and steel).

Other objects, advantages and novel features of the present invention will become apparent from the following detailed description of one or more preferred embodiments when considered in conjunction with the accompanying drawings.

DETAILED DESCRIPTION OF THE DRAWINGS

Figure 1:
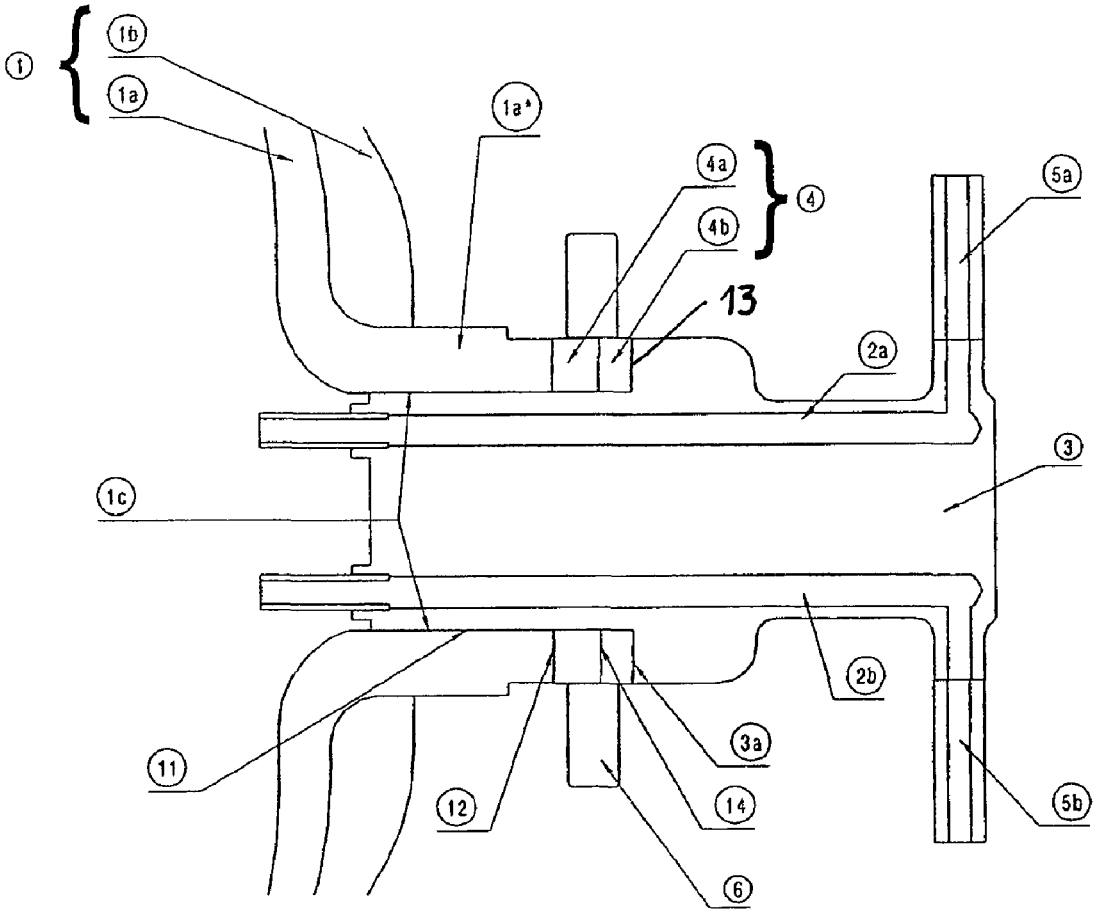
FIGS. 1 to 4 show four embodiments, each of which is depicted in an elementary diagram as a sectional view of the area of the infeed and discharge port of a composite compressed gas tank according to the invention.

In all of the figures identical structural elements are denoted with the same reference numerals; and all of the features that are described in detail may be essential to the invention.

The reference numeral 1 denotes a composite compressed gas tank, of which only the area in the environment of the infeed and discharge port 1*c* of this compressed gas tank 1 is graphically rendered. This composite compressed gas tank includes, as usual, a so-called liner 1*a*, which is made of aluminum and which is enveloped by a CFP (carbon fiber reinforced plastic) outer shell 1*b*. Inside this liner 1*a* the cryogenic hydrogen is supposed to be stored initially in a supercritical state and at a pressure of 300 bar and more.

The hydrogen gas is introduced into the compressed gas tank 1, or more particularly into the cavity of the liner 1*a*, by way of an infeed channel 2*a*, whereas a discharge channel 2*b* is provided for discharging the hydrogen gas from the compressed gas tank 1 (in order to supply a drive unit of the vehicle with this hydrogen as the energy source). These two channels 2*a*, 2*b* are guided through a closing element 3, which is inserted in the infeed and discharge port 1*c* of the compressed gas tank 1, of which the liner 1*a* in this area is configured in the manner of a bottleneck 1*a. Furthermore, these two channels penetrate directly or indirectly a so-called transition element 4, which will be discussed in more detail below. Finally, the channels 2***a* or 2*b* continue in the connecting lines 5*a* or 5*b*, both of which are made of stainless steel.

In the embodiment according to FIG. 1, the closing element 3 is (also) made of stainless steel and connected to the liner 1*a*, that is, screwed into its bottleneck 1*a, by means of a threaded section 11. However, this threaded joint in conjunction with the conventional inserted sealing element cannot satisfy the requirements relating to the imperviousness (in particular also over the entire possible temperature range), for which reason it is necessary to present a welded joint, which, however, is not easily possible between the different materials, that is, the aluminum material of the liner 1***a* and the steel material of the closing element 3. For this reason the present invention provides an annular so-called transition element 4, which is connected at one side to the face side of the bottleneck 1*a of the liner 1***a* and rests with its other side against a stepped shoulder 3*a* of the closing element 3.

Two annular single elements 4*a*, 4*b* are joined together to form this transition element 4. The single element 4*a* that is a part of the transition element 4 and that rests with its free end segment against the bottleneck 1*a, or more particularly against the liner 1***a*, is made of an aluminum material and, therefore, can be welded with the bottleneck 1*a, or more particularly the liner 1***a*, in an annular joining area 12, which runs perpendicularly to the channels 2*a*, 2*b* in the area of the bottleneck 1*a, that is, at the abutting point of these two elements, with the liner 1***a*. The second single element 4*b*, which is a part of the transition element 4 and which rests with its free end segment against the shoulder 3*a* of the closing element 3 in a second joining area 13 that is also annular and runs perpendicular to the channels 2*a*, 2*b* in the area of the bottleneck 1*a, is made of a steel material, so that in this second joining area 13 it is easy to make a welded joint between the second single element 4***b* of the transition element 4 and the stainless steel closing element 3. In a joining area 14 that is once again annular and runs perpendicular to the channels 2*a*, 2*b* in the area of the bottleneck 1*a, the two single elements 4***a*, 4*b* of the transition element 4 are connected together by a special welded joint.

In order to prefabricate this transition element 4 (away from the compression gas tank 1 and the closing element 3), preferably a friction welding process or an explosion welding process (=explosively applied cladding) or, as an alternative, also a diffusion welding process or a rolling process (cold rolling or hot rolling) is used.

Following completion of the assembly and/or welding of the prefabricated transition element 4 with the liner 1*a*, on the one hand, and with the closing element 3, on the other hand, a clamping element 6, which prevents any potential deformations especially of the transition element 4 due to high pressure loads, and which surrounds the transition element, in particular, in the abutting area and/or the joining area 14 of both single elements 4*a*, 4*b* and, thus, the two materials, that is, aluminum and steel, can be placed on the outer periphery of the transition element 4. This clamping element 6 can be preferably a shrunk-on steel ring. Moreover, in the area of the channels 2*a*, 2*b*, the connecting lines 5*a*, 5*b*, which are made preferably of stainless steel, can be easily connected to the closing element 3, which is made of a steel material, by means of a welded joint.

Figure 2:
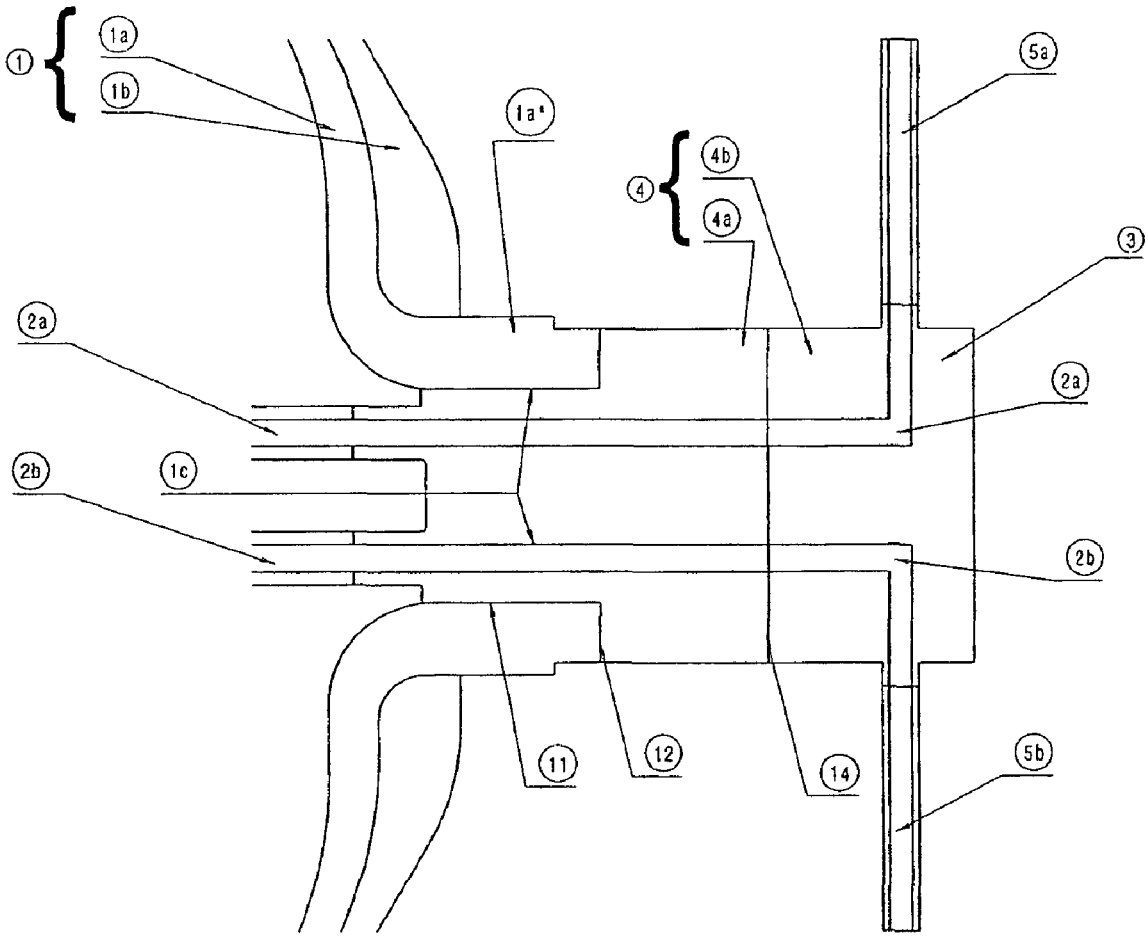

In the embodiment according to FIG. 2, the transition element 4, more precisely its single element 4*a*, which faces the liner 1*a*, assumes simultaneously the function of the closing element 3. In this respect this single element 4*a* of the transition element 4 is made, just like the liner 1*a*, of aluminum and/or a suitable aluminum alloy and is welded with the liner 1*a* or rather with the face side of its bottleneck law in an annular joining area 12 that extends essentially perpendicular to the channels 2*a*, 2*b*. In addition, the single element 4*a* of the transition element 4 is connected to the liner 1*a* by a threaded section 11. However, this latter threaded joint in conjunction with the conventional inserted sealing element cannot satisfy the requirements relating to the imperviousness (in particular, also over the entire potential temperature range), for which reason the aforementioned welded joint is provided in the joining area 12.

The second single element 4*b* of the transition element 4 is (in turn) made of steel, so that the two connecting lines 5*a*, 5*b* can be connected to this single element 4*b* with the channels 2*a*, 2*b*, running in the single element, (once again) by way of a welded joint. Analogous to the embodiment according to FIG. 1, this embodiment according to FIG. 2 also provides that the two single elements 4*a*, 4*b* are connected together by a special welded joint in the annular joining area 14 that extends essentially perpendicular to the course of the channels 2*a*, 2*b* in this area. In order to prefabricate this transition element 4 a little ways away from the compressed gas tank 1 and the connecting lines 5*a*, 5*b*, preferably a friction welding process or an explosion welding process (=explosively applied cladding) or, as an alternative, also a diffusion welding process or a rolling process (cold rolling or hot rolling) is used.

Figure 3:
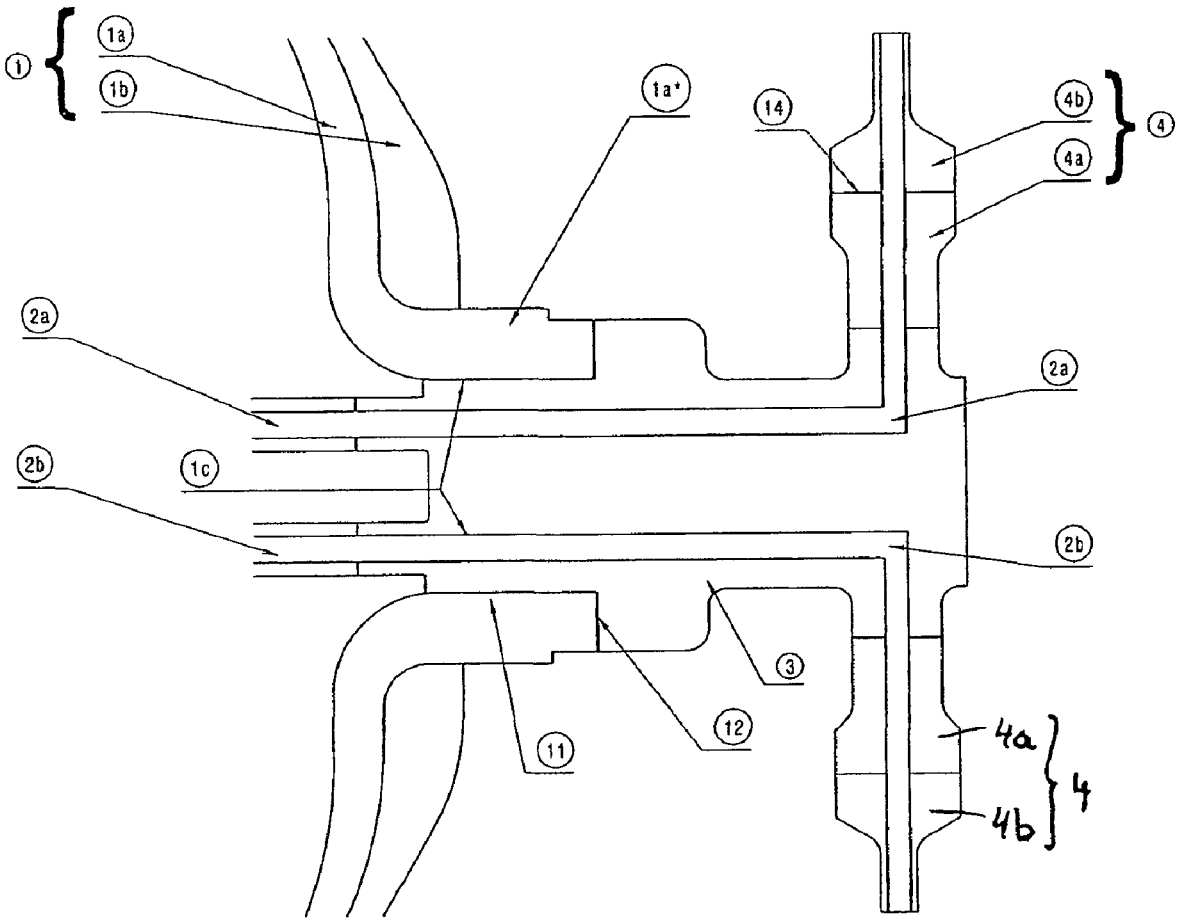

The embodiment according to FIG. 3 provides an independent closing element 3, which is made of an aluminum material and which consequently can be easily welded to the liner 1*a* or rather to its bottleneck 1*a in an annular joining area 12, which extends essentially perpendicular to the course of the channels 2***a*, 2*b* in this area. A similarly simple welded joint is possible between the other end segment of this closing element 3 and the herein two transition elements 4, which are provided for the two channels 2*a*, 2*b* that issue from the closing element 3 in different directions.

Analogous to the preceding embodiments, each of these two transition elements 4 has a first single element 4*a*, which is made of an aluminum material, and an adjoining second single element 4*b*, which is made of a steel material. Analogous to the preceding embodiments, these two single elements 4*a*, 4*b* are or will be connected together in an annular joining area 14, which extends essentially perpendicular to the course of the respective channel 2*a* or 2*b* in this area, by way of a special welded joint (preferably friction welding or explosion welding or other aforementioned processes), before the first single element 4*a* with its free end segment is connected to the closing element 3; and the second single element 4*b* with its free end segment is connected to one of the connecting lines (5*a* or 5*b*), which are not depicted in the drawing, by way of a welded joint.

Figure 4:
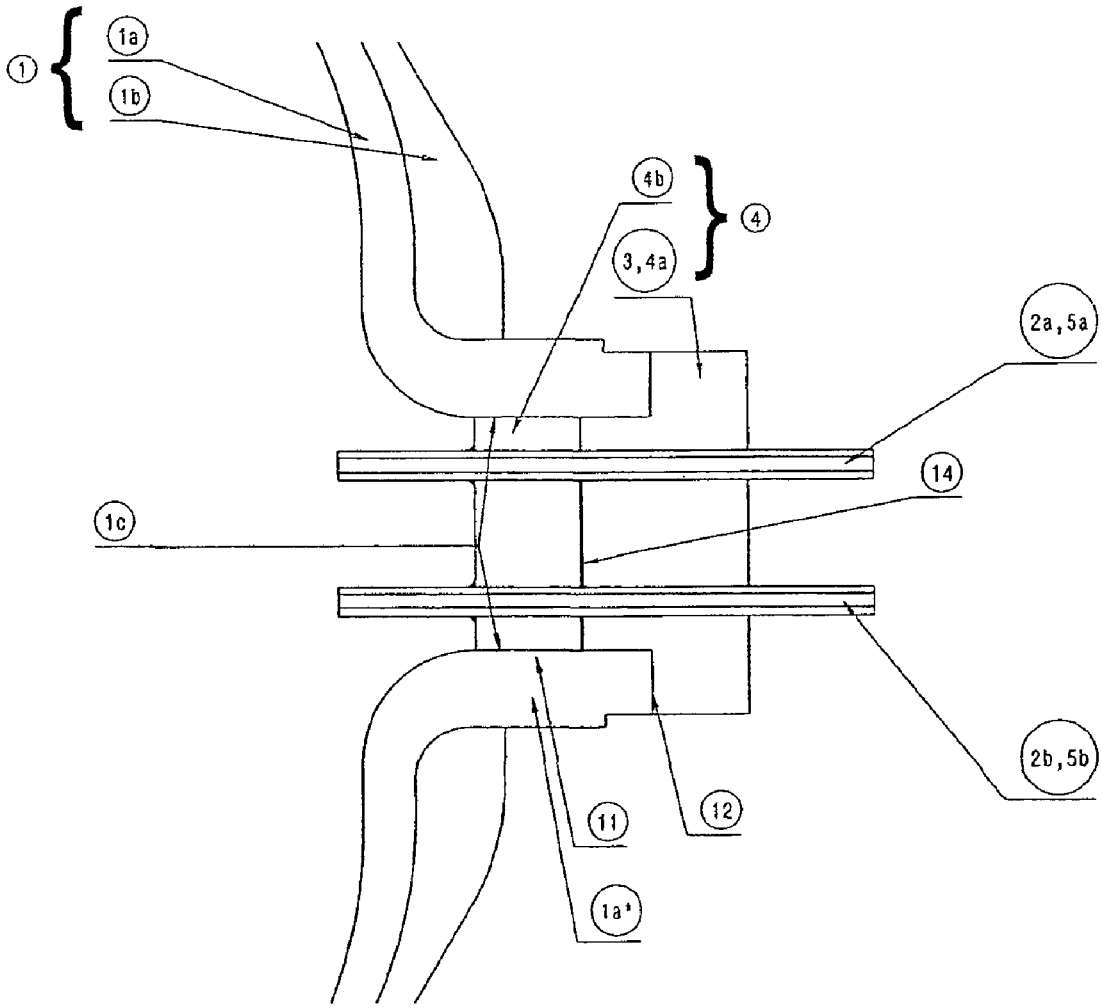

The embodiment according to FIG. 4 is configured in a manner similar to the embodiment according to FIG. 2, but with the difference that the single element 4*b* of the transition element 4, which forms here once again the closing element 3, faces the inside of the tank 1, whereas the other single element 4*a* lies on the outside. Furthermore, in this embodiment the connecting lines 5*a*, 5*b* are welded together with the single element 4*b*, whereas the single element 4*a* is welded together with the liner 1*a* in the joining area 12.

Working on this basis, the so-called transition element 4, which can be fabricated beforehand in a more intensive production process, makes it possible to connect stainless steel connecting lines 5*a*, 5*b* to a composite compressed gas tank 1 having an aluminum liner 1*a* in a simple and reliable way by use of relatively simple welded joints.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A composite compressed gas tank, comprising:

an outer shell;

a liner enveloped by the outer shell, the liner being made of a light metal;

a port for in-feeding and discharging;

a closing element having at least one channel for at least one of in-feeding and discharging of a gas, the closing element being arranged in the port;

a connecting line made of a steel material, the connecting line being connected to a respective channel of the closing element;

a transition element having a first end segment made of a light metal and having a second end segment made of a steel material;

a first weld between the light metal first end segment and one of the liner and the closing element made of a light metal; and a second weld between the steel material second end segment and one of the closing element and the connecting line made of a steel material.

2. The composite compressed gas tank according to claim 1, further comprising a clamping element operatively arranged to surround the transition element.

3. The composite compressed gas tank according to claim 2, wherein the clamping element surrounds the transition element in a joint area of the different materials of the two end segments.

4. The composite compressed gas tank according to claim 1, wherein the light metal is one of an aluminum and an aluminum alloy.

5. The composite compressed gas tank according to claim 4, further comprising a clamping element operatively arranged to surround the transition element.

6. The composite compressed gas tank according to claim 5, wherein the clamping element surrounds the transition element in a joint area of the different materials of the two end segments.

7. The composite compressed gas tank according to claim 1, wherein the two end segments of the transition element have one of a friction weld, explosion weld, diffusion weld, and rolling connection.

8. The composite compressed gas tank according to claim 7, further comprising a clamping element operatively arranged to surround the transition element.

9. The composite compressed gas tank according to claim 8, wherein the clamping element surrounds the transition element in a joint area of the different materials of the two end segments.

* * * * *